US006602110B2

(12) United States Patent
Yi et al.

(10) Patent No.: US 6,602,110 B2
(45) Date of Patent: Aug. 5, 2003

(54) AUTOMATED POLISHING APPARATUS AND METHOD OF POLISHING

(75) Inventors: Allen Y. Yi, Cincinnati, OH (US); Tomasz A. Pol, Cincinnati, OH (US); Michael Hezlep, Cincinnati, OH (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/894,477

(22) Filed: Jun. 28, 2001

(65) Prior Publication Data

US 2003/0003847 A1 Jan. 2, 2003

(51) Int. Cl.[7] ..... B24B 49/00
(52) U.S. Cl. ..... 451/9; 451/5; 451/6
(58) Field of Search ..... 451/9, 8, 5, 6, 451/10, 11, 42, 57, 177, 259, 913

(56) References Cited

U.S. PATENT DOCUMENTS 4,128,968 A 12/1978 Jones
5,347,763 A 9/1994 Miyamato et al.
5,895,311 A * 4/1999 Shiotani et al. ..... 451/5
6,171,175 B1 * 1/2001 Shaikh et al. ..... 451/28
6,224,462 B1 * 5/2001 Yokoyama et al. ..... 451/10
6,257,953 B1 * 7/2001 Gitis et al. ..... 451/5
6,336,842 B1 * 1/2002 Ootsuki et al. ..... 451/21

FOREIGN PATENT DOCUMENTS

EP 0 685 298 B1 11/1994
EP 0 685 298 A1 11/1994
WO WO 99/21682 5/1999

* cited by examiner

*Primary Examiner*—Dung Van Nguyen
(74) *Attorney, Agent, or Firm*—Bruce E. Black

(57) ABSTRACT

A polishing system for polishing a surface of a substrate, such as the surface of an optical pin mold, to a desired surface finish and profile under the automated control of a computer during a polishing cycle. The polishing system includes a polishing spindle assembly that holds and rotates a polishing tool that is contacted under pressure with a surface of the mold pin. A torque sensor is associated with the polishing spindle assembly to sense a torque on the polishing tool during the polishing cycle. The polishing system further includes a feedback control system that dynamically adjusts the position of the polishing spindle assembly in response to the torque sensed by the torque sensor to maintain a substantially constant torque on the polishing tool during the polishing cycle.

6 Claims, 6 Drawing Sheets

AUTOMATED POLISHING APPARATUS AND METHOD OF POLISHING

FIELD OF THE INVENTION

The present invention relates generally to polishing systems for polishing a surface of a substrate to a desired surface profile or finish and, more particularly, to an automated polishing system and method of polishing a surface of a substrate during a polishing cycle using computer control.

BACKGROUND OF THE INVENTION

Automated polishing systems have been developed to polish surfaces of optical and non-optical components to precise surface finishes and surface profiles through an abrasion process using a polishing tool and a polishing slurry. For example, automated polishing systems have been used to obtain precise surface finishes and profiles on spherical and aspherical optical lenses using a computer-controlled polishing spindle that moves a rotating polishing tool across the surface of a rotating lens according to a pre-programmed tool path. The tool path may be defined by coordinates along three orthogonal axes so that the polishing tool follows the general profile of the lens during a polishing cycle to obtain the desired surface finish and profile on the lens. The velocity of the polishing tool is varied as it traverses the lens so that more lens material is removed in areas of relatively slow traverse.

Prior to the polishing cycle, the profile of the lens to be polished is measured and compared with a reference lens profile stored in a computer. The computer determines whether the actual surface profile of the lens differs from the reference lens profile by a predetermined error amount. If so, the computer executes a material removal algorithm that determines a predetermined tool path for the polishing tool to follow across the surface of the lens and the required velocity profile of the polishing tool so that the desired surface finish and profile will be obtained during the polishing cycle.

The amount of material removed from the surface of the lens is determined by the polishing pressure applied by the polishing tool to the surface of the lens and also by the velocity profile of the polishing tool as it traverses the lens during a polishing cycle. The amount of material removed from the surface of the lens is increased with either an increase in the pressure applied by the polishing tool to the surface of the lens or an increase in the dwell time of the polishing head in a particular annular region of the lens.

Accordingly, in the event fluctuations occur in the pressure applied by the polishing tool to the surface of the lens as it traverses the lens, without a change in the velocity profile of the polishing tool to compensate for the fluctuation in polishing pressure, the lens will not obtain the desired surface finish and profile during the polishing cycle. In those areas of increased polishing pressure, more lens material will be removed than desired, while other areas receiving a lighter polishing pressure will not have enough material removed to obtain the desired surface finish and profile. These pressure fluctuations may occur due to positioning inaccuracies in the polishing system mechanics responsible for moving the polishing spindle during the polishing cycle, and also to the surface profile geometry encountered by the polishing tool during the polishing cycle.

Thus, there is a need for an automated polishing system for optical and non-optical components that is not susceptible to polishing pressure fluctuations during a polishing cycle so as to provide uniform surface finishes and accurate curve profiles on the polished component.

SUMMARY OF THE INVENTION

The present invention overcomes the foregoing and other shortcomings and drawbacks of automated polishing systems and polishing methods heretofore known. While the invention will be described in connection with certain embodiments, it will be understood that the invention is not limited to these embodiments. On the contrary, the invention includes all alternatives, modifications and equivalents as may be included within the spirit and scope of the present invention.

The polishing system of the present invention is particularly adapted to polish a surface of a substrate, such as a surface of an optical mold pin, to a desired surface profile and finish under the automated control of a computer during a polishing cycle. The polishing system includes a polishing spindle assembly that is adapted to support the rotating polishing tool and is operable to move in at least one of a direction toward and away from the rotating mold pin to contact the polishing tool on the surface of the mold pin with a predetermined torque on the polishing tool during the polishing cycle. The polishing tool is contacted under pressure with the surface of the mold pin during a polishing cycle to obtain the desired surface profile and finish on the mold pin. The polishing tool includes a polishing head that is covered with an abrasive polishing paste and placed into contact with the mold pin during the polishing cycle to remove material from the surface of the mold pin through abrasion.

A positioning mechanism is operatively connected to the polishing spindle assembly and is operable to move the polishing spindle assembly in at least one of a direction toward and away from the mold pin. In one embodiment, the positioning mechanism has three (3) orthogonal axes of translation to guide movement and control positioning of the polishing spindle assembly and the polishing tool relative to the mold pin during a polishing cycle.

A control is operatively coupled to the positioning mechanism and the polishing spindle assembly. The control is operable to adjust positioning of the polishing spindle assembly in at least one of a direction toward and away from the substrate to maintain the torque on the polishing tool substantially constant, and therefore the contact pressure applied by the polishing tool to the surface of the mold pin substantially constant, during the polishing cycle.

In accordance with one aspect of the present invention, a torque sensor is associated with the polishing spindle assembly and is operatively coupled to the control. The torque sensor is operable to sense a torque on the polishing tool during the polishing cycle. The control is responsive to the torque sensed by the torque sensor to adjust positioning of the polishing spindle assembly in at least one of a direction toward and away from the mold pin to maintain the torque on the polishing tool substantially constant during the polishing cycle. The torque sensor may be mounted to remain substantially stationary during the polishing cycle or, alternatively, the torque sensor may be mounted to rotate during the polishing cycle.

By maintaining the torque substantially constant on the polishing tool during the polishing cycle, the polishing system of the present invention is able to provide uniform surface finishes and accurate curve profile on the surface of the mold pin. The polishing system maintains a constant polishing pressure on the polishing tool during the polishing cycle to accurately and reliably remove material from the surface of the mold pin so that the desired surface finish and curve profile is obtained.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
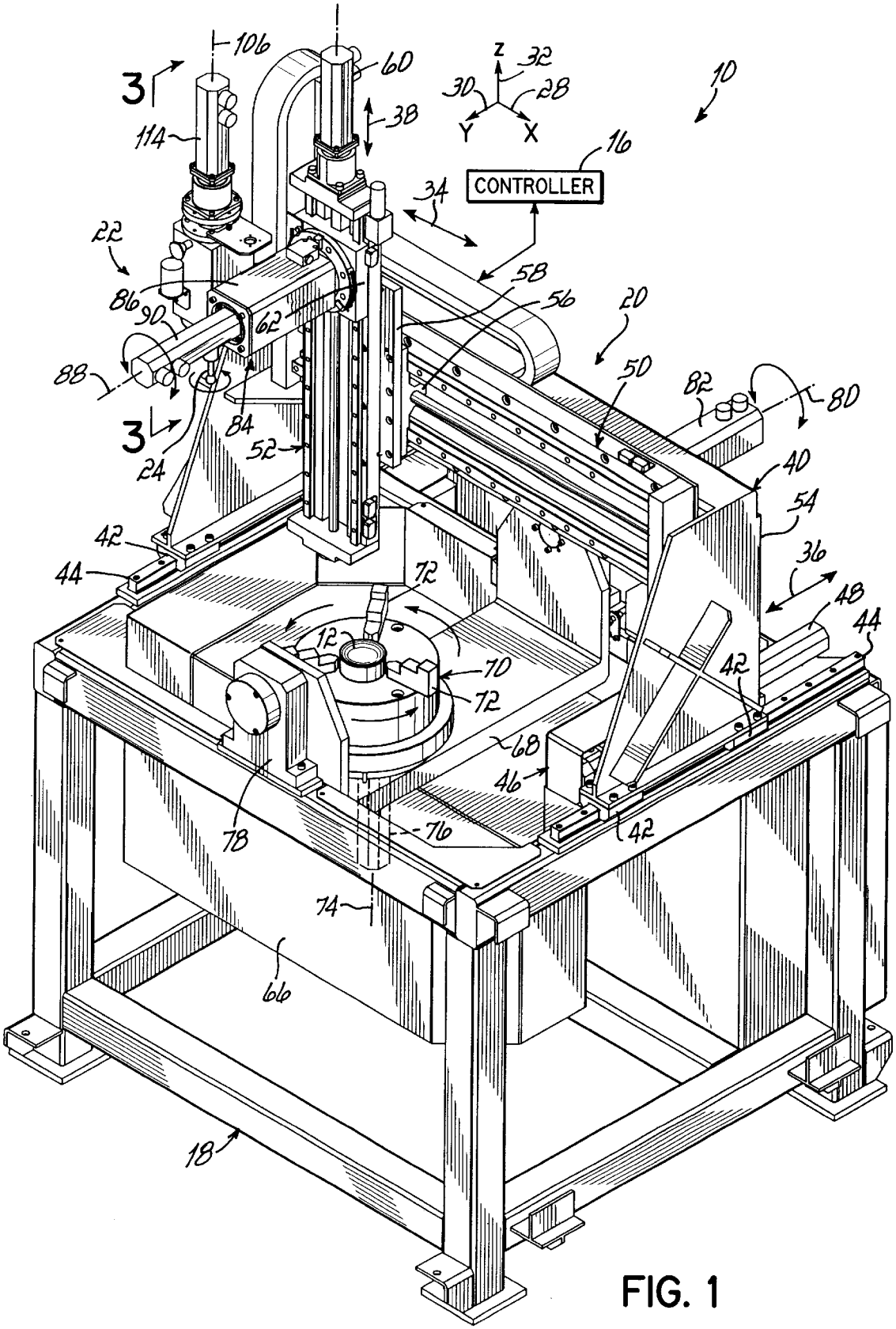
FIG. 1 is a perspective view of an automated polishing system for polishing a surface of a substrate in accordance with the principles of the present invention.
Figure 2:
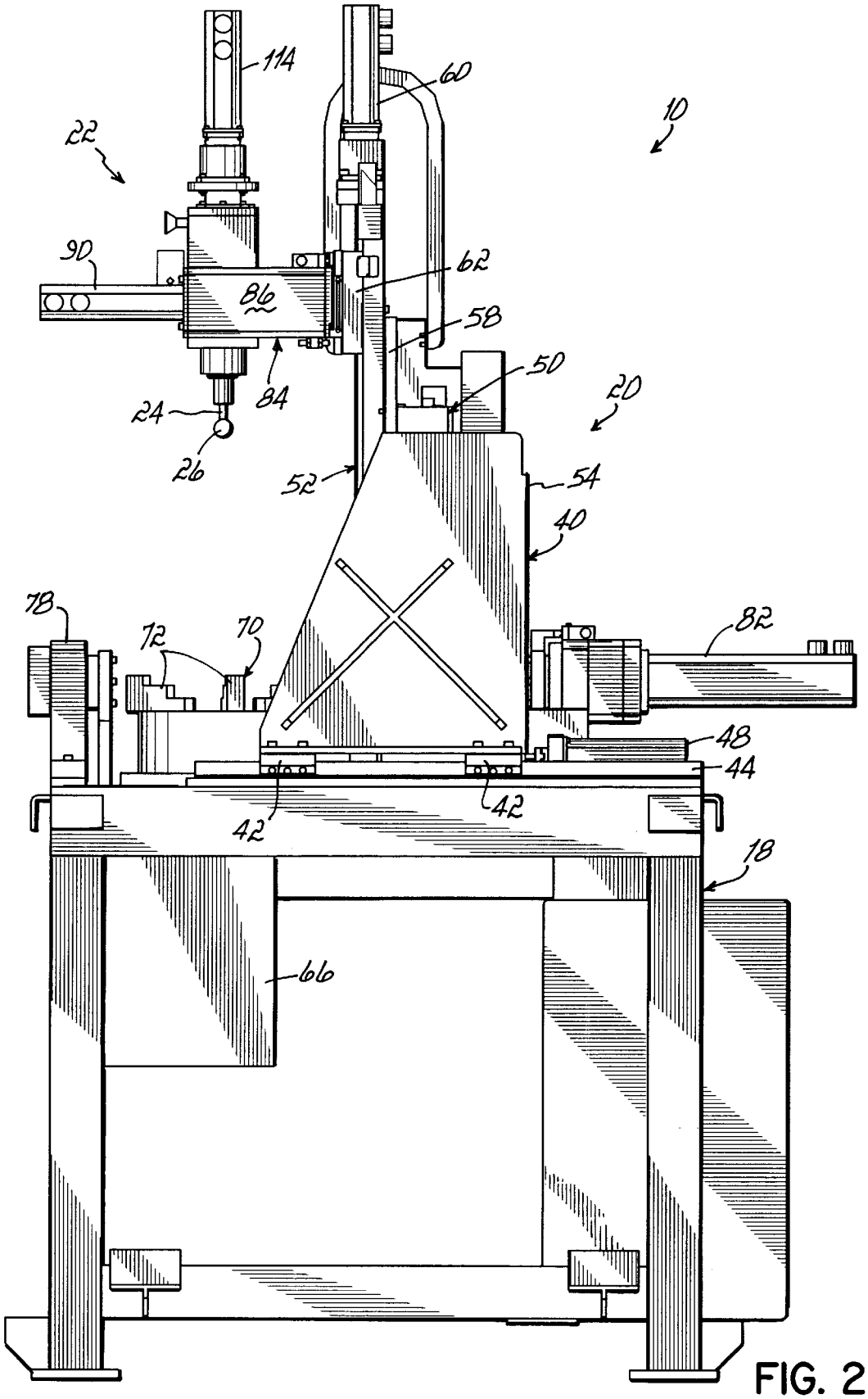
FIG. 2 is a side elevational view of the automated polishing system shown in FIG. 1.
Figure 3:
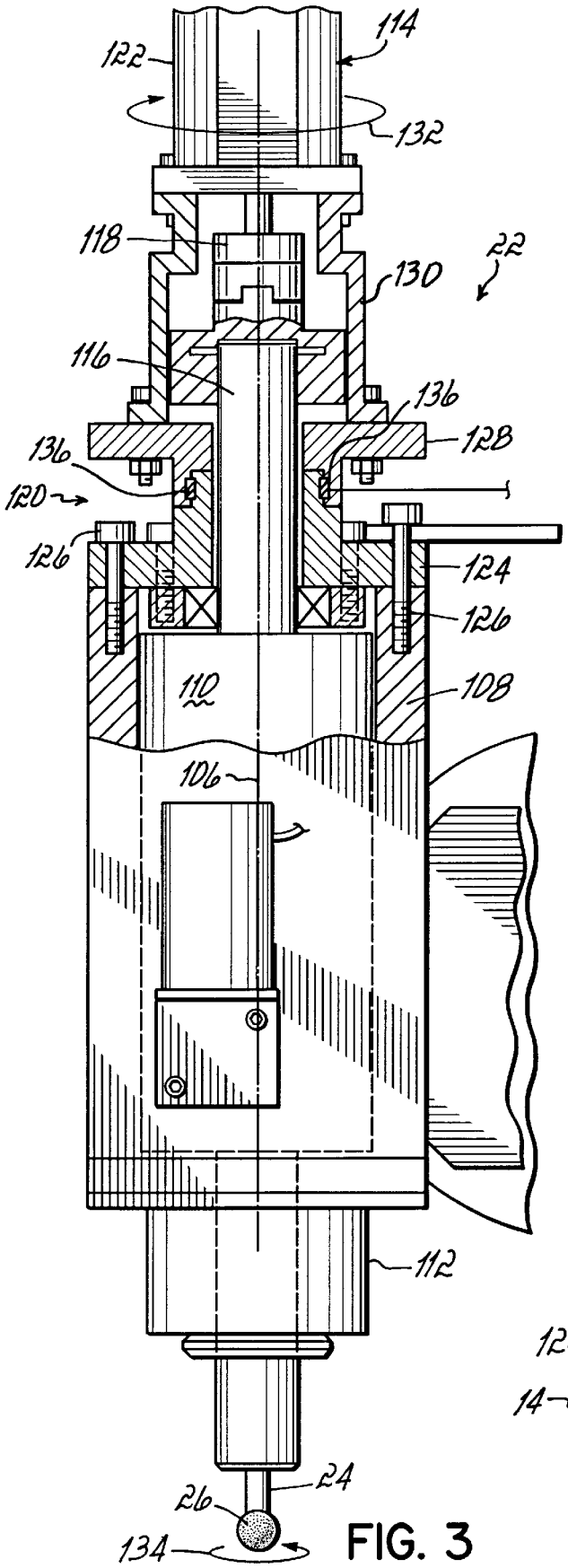
FIG. 3 is a partial cross-sectional view taken along line 3—3 of FIG. 1, illustrating a polishing spindle assembly of the automated polishing system in accordance with one aspect of the present invention.

With reference to the Figures, and to FIGS. 1–3 in particular, an automated polishing system 10 is shown in accordance with the principles of the present invention. As will be described in more detail below, polishing system 10 is particularly adapted to polish a surface of a substrate, such as the surface 12 (FIG. 3A) of an optical mold pin 14 (FIG. 3A), to a desired surface profile and finish under the automated control of a controller 16 (FIG. 1) during a polishing cycle. It will be understood that controller 16 may comprise a desktop or PC-based computer or, alternatively, a combination of a PC-based computer and an industrial controller known to those skilled in the art. While the present invention will be described in detail herein in an exemplary environment for polishing the surface 12 of optical mold pin 14, those of ordinary skill in the art will appreciate that the polishing system 10 of the present invention is readily adapted to polish a variety of substrate surfaces, including metal, plastic and other material surfaces, and to polish a variety of parts, including both optical and non-optical parts, without departing from the spirit and scope of the present invention.

As those skilled in the art will appreciate, mold pin 14 is used in the manufacture of plastic optical lenses (not shown) for projection television sets and various other types of optical systems. During the optical lens manufacturing process, a pair of mold pins 14, typically manufactured from steel, are inserted into opposite ends of a mold cavity (not shown) with the profiled surfaces 12 of the mold pins 14 positioned in spaced and confronting relationship within the mold cavity (not shown). The mold cavity (not shown) is then injected with molten plastic lens material so that the confronting profiled surfaces 12 of the mold pins 14 generally define the optical surface profiles of the optical lens (not shown). For this reason, the surfaces 12 of the mold pins 14 must be polished to very precise surface finishes and profiles so that the desired optical surface profiles are obtained on the optical lens during the lens molding process. The optical lens (not shown) may then be polished through a further polishing process to achieve the desired optical characteristics of the lens.

Further referring to FIGS. 1–3, the polishing system 10 includes a support frame 18, a positioning mechanism 20 supported by the support frame 18, and a polishing spindle assembly 22 mounted to the positioning mechanism 20. As will be described in greater detail below, polishing spindle assembly 22 is adapted to hold and rotate a polishing tool 24, known to those skilled in the art, that is contacted under pressure with the surface 12 of the mold pin 14 during a polishing cycle to obtain the desired surface profile and finish on the mold pin 14. The polishing tool 24 includes a polishing head 26 that is covered with an abrasive polishing paste and placed into contact with the mold pin 14 during the polishing cycle to remove material from the surface 12 of the mold pin 14 through abrasion as will be described in detail below.

As shown FIG. 1, the positioning mechanism 20 has three (3) orthogonal axes of translation 28, 30 and 32, respectively, to guide movement and control positioning of the polishing spindle assembly 22 and the polishing tool 24 relative to the mold pin 14 during a polishing cycle. The translational axis 28, referred to herein as the "X" axis, is aligned generally parallel with the longitudinal axis (not shown) of the polishing system 10 so that movement of the positioning mechanism 20 along the "X" axis 28, represented by arrow 34, moves the polishing spindle assembly 22 in a side-by-side manner along a pre-programmed tool path and with a pre-programmed velocity relative to the mold pin 14. The translational axis 30, referred to herein as the "Y" axis, is aligned generally perpendicular to the longitudinal axis of the polishing system 10 so that movement of the positioning mechanism 20 along the "Y" axis 30, represented by arrow 36, moves the polishing spindle assembly 22 and polishing tool 24 fore and aft along a pre-programmed tool path and with a pre-programmed velocity relative to the mold pin 14. Lastly, the translational axis 32, referred to herein as the "Z" axis, is aligned generally perpendicular to the "X" and "Y" axes 28, 30, respectively, so that movement of the positioning mechanism 20 along the "Z" axis 32, represented by arrow 38, raises and lowers the polishing spindle assembly 22 and polishing tool 24 to a pre-programmed position relative to the mold pin 14.

Further referring to FIG. 1, the positioning mechanism 20 includes a gantry 40 that is slidably mounted to the frame 18 through attached bearing blocks 42 that are adapted to slide on a pair of linear rails 44 aligned generally along the "Y" axis 30 on opposite sides of the frame 18. Movement of the gantry 40 along the rails 44 is controlled by a screw assembly 46 that operates under the control of a driver or servomotor 48. The servomotor 48 receives "Y" axis control signals from the controller 16 and, in response to the control signals, is operable to move the gantry 40, and the associated polishing spindle assembly 22 mounted thereto, along the "Y" axis in a pre-programmed direction and along a pre-programmed tool path during a polishing cycle. One or more position encoders (not shown) are provided to apply position status information to the controller 16 for monitoring the position of the gantry 40 along the "Y" axis 30. As will be described in greater detail below, the polishing spindle assembly 22 may remain stationary at a pre-programmed position along the "Y" axis during a polishing cycle, such as along the center of the mold pin 14. Alternatively, the polishing spindle assembly 22 may move along a pre-programmed tool path and with a pre-programmed velocity along the "Y" axis 30 during a polishing cycle.

The gantry 40 includes a pair of linear slide assemblies 50 and 52 that guide movement of the polishing spindle assembly 22 along the "X" and "Z" axes 28 and 32, respectively. Linear slide assembly 50 is mounted to an upstanding wall 54 of the gantry 40, and controls positioning and movement of the polishing spindle assembly 22 along the "X" axis 28 through a driver or servomotor (not shown). The "X" axis servomotor (not shown) receives "X" axis control signals from the controller 16 and, in response to the control signals, is operable to move a slide block 56 supporting the polishing spindle assembly 22 in a pre-programmed direction and with a pre-programmed velocity along the "X" axis 28 during a polishing cycle. One or more position encoders (not shown) are provided to apply position status information to the controller 16 for monitoring the position of the polishing spindle assembly 22 along the "X" axis 28.

Linear slide assembly 52 is mounted to the slide block 56 of the linear slide assembly 50 through an adaptor plate 58 so that linear slide assembly 52 moves along the "X" axis 28 under the control of the linear slide assembly 50. Linear slide assembly 52 controls positioning and movement of the polishing spindle assembly 22 along the "2" axis 32 through a driver or servomotor 60. The servomotor 60 receives "Z" axis control signals from the controller 16 and, in response to the control signals, is operable to move a slide block 62 supporting the polishing spindle assembly 22 in a pre-programmed direction and to a pre-programmed position along the "Z" axis 32 during a polishing cycle as will be described in greater detail below. One or more position encoders 64 (FIG. 5) are provided to apply position status information to the controller 16 for monitoring the position of the polishing spindle assembly 22 along the "Z" axis 32.

The support frame 18 of the polishing system 10 includes a slurry pan 66 that retains the polishing slurry used during the polishing of mold pin 14. A U-shaped tilt table 68 is mounted generally within the slurry pan 66 for supporting a workpiece spindle assembly 70. As shown in FIG. 1, the workpiece spindle assembly 70 includes three (3) circumferentially spaced and mechanically adjustable jaws 72 that retain the mold pin 14 on the spindle assembly 70 during the polishing cycle. The workpiece spindle assembly 70 has a single axis of rotation 74 so that the spindle assembly 70, and mold pin 14 mounted thereto, rotate about the axis 74 during the polishing cycle under the control of a driver or servomotor 76. The servomotor 76 receives control signals from the controller 16 and, in response to the control signals, is operable to rotate the spindle assembly 70 and the mold pin 14 in a pre-programmed direction and with a pre-programmed rotational speed during the polishing cycle.

Further referring to FIG. 1, the tilt table 68 is rotatably supported in a pair of bearing mounts 78 supported on the frame 18, and has a single tilt or "θ" axis 80 aligned generally along the "Y" axis 30. The angular position or tilt of the tilt table 68 and mold pin 14 can be adjusted about the tilt axis 80 during the polishing cycle under the control of a driver or servomotor 82. The servomotor 82 receives control signals from the controller 16 and, in response to the control signals, is operable to tilt the tilt table 68 and mold pin 14 in a pre-programmed angular direction and to a pre-programmed angular position during the polishing cycle. Tilting of the mold pin 14 may be required during the polishing cycle to ensure proper contact of the polishing tool 24 with the surface 12 of the mold pin 14 as will be described in greater detail below. One or more position encoders (not shown) are provided to apply position status information to the controller 16 for monitoring the angular position or tilt position of the tilt table 70 about the tilt axis 80.

Referring now to FIGS. 1 and 2, the polishing spindle assembly 22 is operatively connected to the linear slide assembly 52 through a tilt mechanism 84. As shown in FIG. 1, the tilt mechanism 84 includes a mounting block 86 that is rotatably supported by the slide block 62, and has a single tilt axis 88 that is aligned generally along the "Y" axis 30. The polishing spindle assembly 22 is mounted to the mounting block 86 of the tilt mechanism 84 through suitable fasteners (not shown). The angular position or tilt of the tilt mechanism 84 and the polishing spindle assembly 22 can be adjusted about the tilt axis 88 during the polishing cycle under the control of a driver or servomotor 90. The servomotor 90 receives control signals from the controller 16 and, in response to the control signals, is operable to tilt the tilt mechanism 84 and polishing spindle assembly 22 in a pre-programmed angular direction and to a pre-programmed angular position during the polishing cycle.

Figure 3A:
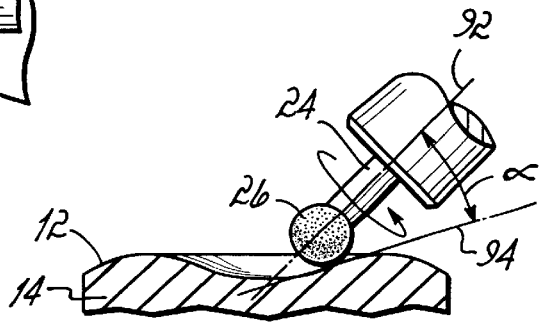
FIG. 3A is an enlarged side elevational view showing contact of a rotating polishing tool supported by the automated polishing system with a surface of a substrate during a polishing cycle.

Preferably, as shown in FIG. 3A, the polishing spindle assembly 22 is tilted at an angle "α" during the polishing cycle so that an axis 92 of the polishing tool 24 is maintained at a polishing angle in a range between about 10° and about 30° relative to a plane 94 that lies tangent to the surface 12 of the mold pin 14 during the polishing cycle. The tilt table 68 may be angularly adjusted as described in detail above to permit the desired polishing angle of the polishing tool 24 to be maintained during the polishing cycle for mold pins 14 having steep walls (not shown) or deep curves (not shown). One or more position encoders (not shown) are provided to apply position status information to the controller 16 for monitoring the angular position or tilt position of the tilt mechanism 84 about the tilt axis 88.

Figure 6:
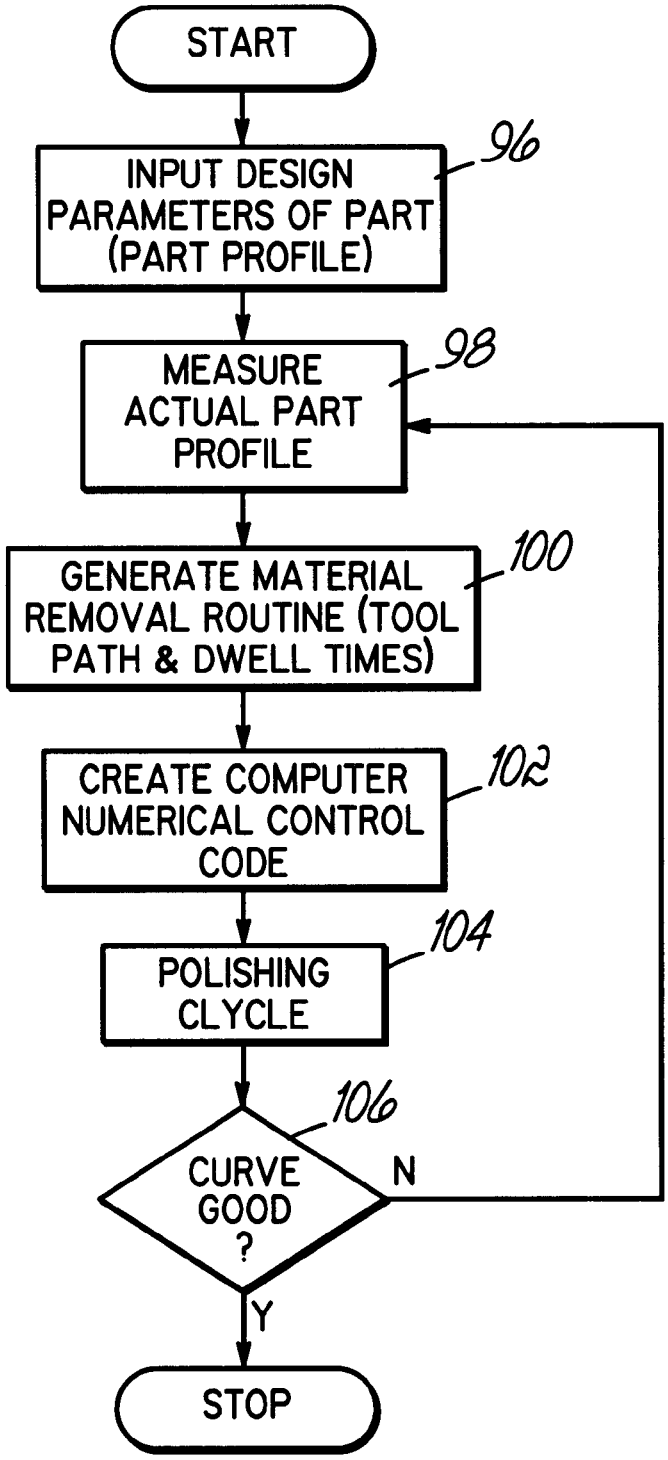
FIG. 6 is a block diagram illustrating a method of polishing a surface of a substrate to a desired surface profile in accordance with the principles of the present invention.

FIG. 6 shows an exemplary polishing process for polishing the mold pin 14 to a desired surface finish and profile in accordance with one embodiment of the present invention. Initially, at step 96, the desired design parameters of the mold pin 14, i.e., the part profile of a mold pin having the desired surface finish and geometric surface profile, are entered into a database of a computer system (not shown). At step 98, the geometric surface profile of a mold pin 14 to be polished is measured using a coordinate measuring machine so that the actual surface profile of the mold pin 14 can be compared to the reference mold pin profile stored in a database. The computer system (not shown) determines whether the actual surface profile of mold pin 14 differs from the reference mold pin surface profile by a predetermined error amount. If so, the computer system (not shown) executes a material removal algorithm at step 100 that determines a predetermined tool path for the polishing head 26 to follow across the surface 12 of the mold pin 14 and the required dwell times to achieve the desired surface finish and profile.

For example, the tool path may travel in a direction along the "X" axis 28 over the center of the mold pin 14, beginning at the peripheral edge of the mold pin 14 and moving radially inwardly to the center of the part so that the desired material removal on the surface of the mold pin 14 is achieved in a single pass. Alternatively, the tool path may include a return pass of the polishing tool 24 in a direction along the "X" axis 28 from the center of the mold pin 14 radially outwardly to the peripheral edge of the part. In another alternative, the tool path may include one or more passes in a direction along the "X" axis 28 as described in detail above, and one or more transverse passes in a direction along the "Y" axis 30. The material removal algorithm optimizes the tool path to remove the desired amount of material on the surface 12 of the mold pin 14 in an optimized manner. After this optimization process in step 100, the material removal algorithm generates computer numerical control code at step 102 that is used by the controller 16 to control movement and positioning of the polishing spindle assembly 22 and the associated polishing tool 24 during a polishing cycle. At step 104, polishing system 10 performs a polishing cycle on the mold pin 14 according to the computer numerical control code generated at step 102 and executed by the controller 16. At step 106, a determination is made whether the desired surface profile and finish has been obtained on the mold pin 14. If yes, the polishing cycle is complete and the mold pin 14 is removed from the system 10. Otherwise, the profile of mold pin 14 is re-measured at step 98 and another polishing cycle is performed on the mold pin 14.

It will be understood by those skilled in the art that the amount of material removed from the surface 12 of mold pin 14 is determined by the polishing pressure applied by the polishing head 26 to the surface 12 of mold pin 14 and also by the amount of time the polishing head 26 dwells in a particular annular region of the rotating mold pin 14. The amount of material removed from the surface 12 of the mold pin 14 is increased with either an increase in the pressure applied by the polishing head 26 to the surface 12 of the mold pin 14 or an increase in the dwell time of the polishing head 26 in a particular annular region of the mold pin 14.

In accordance with the principles of the present invention, the pressure applied by the polishing head 26 to the surface 12 of the mold pin 14 is maintained substantially constant during the polishing cycle. In this way, the amount of material removed from the surface 12 of the mold pin 14 is determined or controlled by controlling the dwell times or velocity profile of the polishing head 26 as it moves along the pre-programmed tool path across the surface 12 of the mold pin 14.

Referring to FIG. 3, polishing spindle assembly 22 is shown in greater detail in accordance with one aspect of the present invention for maintaining a substantially constant contact pressure of the polishing head 26 with the surface 12 of the mold pin 14 during the polishing cycle. The polishing spindle assembly 22 has a single axis of rotation 106 (FIG. 1) and includes a spindle housing 108 that is mounted to the mounting block 86 of the tilt mechanism 84 as described in detail above. A spindle 110 is mounted for rotation about the axis 106 within the spindle housing 108 and is operable to receive the polishing tool 24 in a receiving tool chuck 112. A spindle driver or servomotor 114 is operatively connected to a shaft extension 116 of the spindle 110 through a coupling 118. The servomotor 114 receives control signals form the controller 16 and, in response to the control signals, is operable to rotate the spindle 110 and polishing tool 24 in a pre-programmed direction and with a pre-programmed rotational speed during the polishing cycle.

Further referring to FIG. 3, and in accordance with one aspect of the present invention, a substantially stationary torque sensor 120 is provided to sense a torque on the polishing tool 24 during the polishing cycle that is related to the pressure being applied by the polishing head 26 to the surface 12 of the mold pin 14. The torque sensor 120 is operatively coupled to the controller 16 which monitors the torque on the polishing tool 24, as sensed by the torque sensor 120, during the polishing cycle. As will be described in greater detail below, the controller 16 is responsive to the torque sensed by the torque sensor 120, and applies command signals to the servomotor 60 of the "Z" axis linear slide assembly 52 to dynamically adjust the "Z" axis position of the polishing spindle assembly 22 to maintain a substantially constant torque on the polishing tool 24, and therefore a substantially constant contact pressure applied by the polishing head 26 to the surface 12 of the mold pin 14, during the polishing cycle.

In accordance with one aspect of the present invention, the torque sensor 120 is operatively connected to the spindle housing 108 and a motor housing 122 of the servomotor 114 to sense a relative torque therebetween during a polishing cycle. The torque sensor 120 has one body member 124 that is rigidly connected to the spindle housing 108 through fasteners 126, and a second body member 128 that is rigidly connected to the motor housing 122 of the servomotor 114 through an adaptor flange 130. The torque sensor body members 124 and 128 are mounted to rotate relative to each other through a very small angle when a torque is imparted on the polishing tool 24 during a polishing cycle.

More particularly, the torque sensor body member 124 is fixed against rotation due to its connection with the spindle housing 108. The torque sensor body member 128 is free to rotate with the motor housing 122, as represented by arrow 132, in response to a torque imparted on the polishing tool 24. As those skilled in the art will appreciate, the polishing tool 24 and spindle 110 are connected to a rotor (not shown) of the servomotor 114. When a torque is applied to the polishing tool 24 as it rotates in the direction represented by arrow 134, the rotor (not shown) connected to the polishing tool 24 and spindle 110 imparts a torque on the motor housing 122 that causes the motor housing 122 to rotate in a direction opposite to the rotational direction of the polishing tool 24, as represented by the arrow 132. A strain gauge, indicated diagrammatically as numeral 136 and understood by those skilled in the art, is connected between the body members 124 and 128 of the torque sensor 120 and is operable to apply an electrical output, such as a voltage, to the controller 16 that is proportional to the relative torque between the body members 124 and 128 caused by the rotation of the motor housing 122 as described in detail above.

Figure 4:
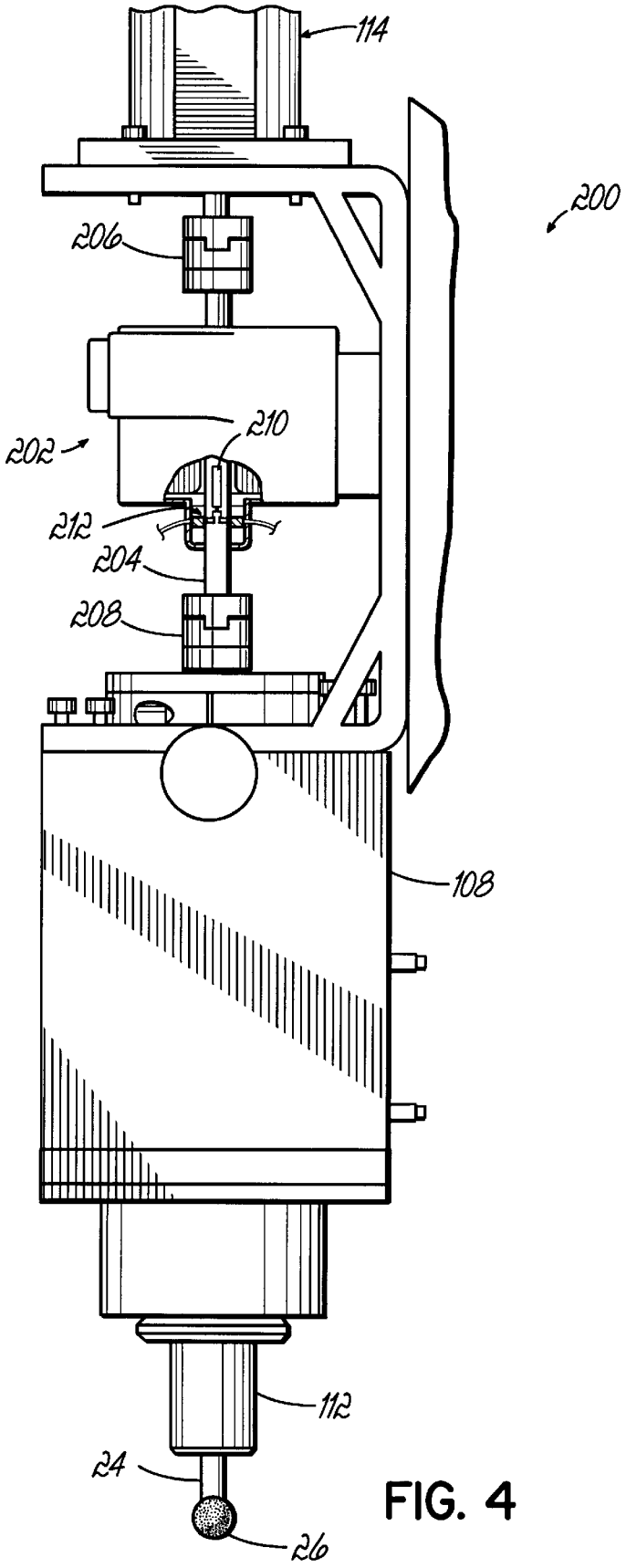
FIG. 4 is a view similar to FIG. 3 illustrating a polishing spindle assembly in accordance with an alternative aspect of the present invention.

Referring now to FIG. 4, a polishing spindle assembly 200 in accordance with another aspect of the present invention is shown, where like numerals represent like parts to the polishing spindle assembly 22. In accordance with this aspect of the present invention, a rotary torque sensor 202 is mounted on a shaft extension 204 of the spindle 110. A coupling 206 connects one end of the shaft extension 204 to the servomotor 114 and another coupling 208 connects the other end of the shaft extension 204 to the spindle 110. The rotary torque sensor 202 includes a torque sensor 210 mounted to the shaft extension 204 that is operable to apply an electrical output, such as a voltage, to the controller 16 through a slip ring assembly 212 that is proportional to the torque imparted on the shaft extension 204 during a polishing cycle. A suitable rotary torque sensor for use in the present invention is the Model MCRT 49000T (1–2) rotary torque meter commercially available from the S. Himmelstein and Company of Hoffman Estates, Ill., although other rotary torque meters are possible as well. The controller 16 is responsive to the torque sensed by the rotary torque sensor 202 to maintain a substantially constant torque on the polishing tool 24 during a polishing cycle as described in detail above.

Figure 5:
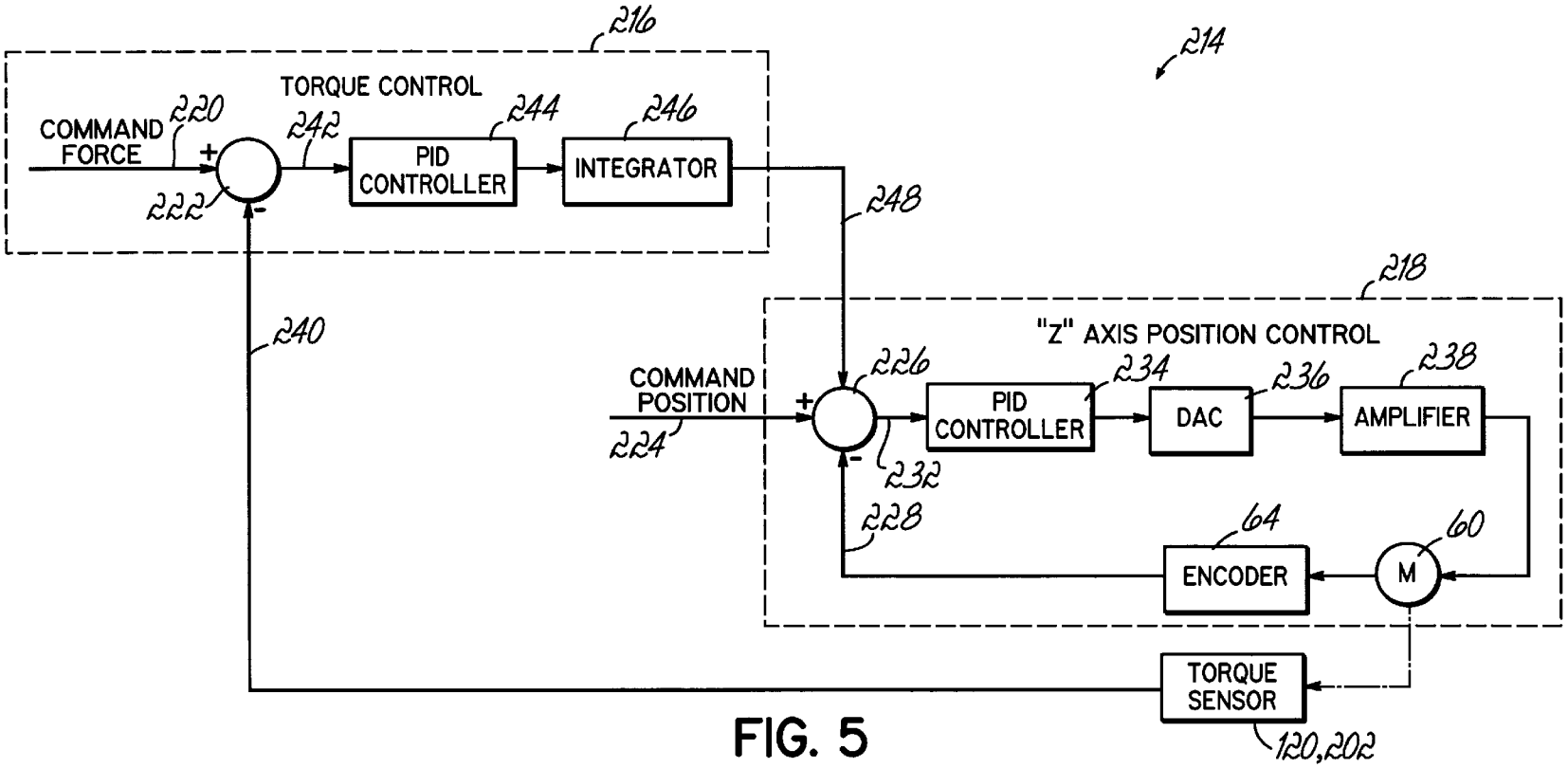
FIG. 5 is a functional block diagram illustrating a feedback control system including a torque control and a position control used in the automated polishing system of FIG. 1.

As shown in FIG. 5, the controller 16 uses the torque data generated by the torque sensors 120, 202 in a feedback control system 214. The feedback control system 214 includes a torque control loop 216 coupled to a "Z" axis position control loop 218 that operate to dynamically adjust the "Z" axis position of the polishing spindle assembly 22 to maintain a substantially constant torque on the polishing tool 24, and therefore a substantially constant contact pressure applied by the polishing head 26 to the surface 12 of the mold pin 14, during the polishing cycle.

In operation during a polishing cycle, a predetermined torque value, such as about 0.50 in-lbs, is applied as an input 220 to a summation node 222 of the torque control loop 216. The torque value applied to the torque control loop 216 represents the desired torque on the polishing tool 24, and therefore the desired contact pressure applied by the polishing head 26 to the surface 12 of the mold pin 14, during a polishing cycle. From the computer numerical control code generated at step 102 of FIG. 6, the controller 16 applies a "Z" axis command signal as an input 224 to a summation node 226 of the "Z" axis position control 218. The encoder 64 senses the position of the polishing spindle assembly 22 along the "Z" axis 32 and applies this position data as a second input 228 to the summation node 230. The "Z" axis position control loop 218 compares the commanded "Z" axis position of the polishing spindle assembly 22 applied at input 224 with its actual position as determined by the encoder 64 and applied at input 228, and generates a "Z" axis position error signal at the output 232 of the summation node 226. The "Z" axis position error signal is processed through a proportional-integral-derivative (PID) controller 234, digital-to-analog converter (DAC) 236 and amplifier 238, and then applied to the servomotor 60 of the "Z" axis linear slide 52 to position the polishing spindle assembly 22 at the commanded "Z" axis position during the polishing cycle.

The torque sensors 120 and 202 sense the torque on the polishing tool 24 during the polishing cycle and apply this value as a second input 240 to the summation node 222 of the torque control loop 216. The torque control loop 216 compares the predetermined torque value applied at input 220 with the actual torque on the polishing tool 24 as sensed by the torque sensors 120 and 202 and applied at input 240, and generates a torque error signal at the output 242 of the summation node 222. The torque error signal is processed through a proportional-integral-derivative (PID) controller 244 and integrator 246, and then applied as a "Z" axis position correction signal at a third input 248 of the summation 226. The "Z" axis position correction signal is a signal generated to offset the position of the polishing spindle assembly 22 from its commanded position to maintain a substantially constant torque on the polishing tool 24, and therefore a substantially constant contact pressure applied by the polishing head 26 to the surface 12 of the mold pin 14, during the polishing cycle. As the torque increases or decreases due to polishing pressure fluctuations, the feedback control system 214 dynamically adjusts the "Z" axis position of the polishing spindle assembly 22 in response to the torque sensed by the torque sensors 120 and 202 to maintain a substantially constant torque on the polishing tool 24 during the polishing cycle.

By maintaining the torque substantially constant on the polishing tool 24 during the polishing cycle, the polishing system 10 of the present invention is able to provide uniform surface finishes and accurate curve profiles on the mold pin surfaces 12. The polishing system 10 maintains a constant polishing pressure on the polishing tool 24 during the polishing cycle, and varies the dwell times of the polishing tool 24 as it travels along its tool path across the mold pin 14 to accurately and reliably remove material from the mold pin surface 12 so that the desired surface finish and profile is obtained.

While the present invention has been illustrated by a description of various embodiments and while these embodiments have been described in considerable detail, it will be appreciated by those of ordinary skill in the art that departures may be made from such details without departing from the spirit or scope of applicants' invention. For example, it is contemplated that other torque sensing devices and methods of sensing the torque on the polishing tool 24 are possible as well. For example, it is contemplated that the torque on the polishing tool 24 can be sensed from the current or voltage of the servomotor 114. Therefore, the invention in its broader aspects is therefore not limited to the specific details, representative apparatus and method, and illustrative example shown and described.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicants' general inventive concept.

Having described the invention, what is claimed is:

1. An apparatus for polishing a surface of a substrate, comprising:

a polishing spindle assembly adapted to support a rotating polishing tool and operable to move in at least one of a direction toward and away from the substrate to contact the polishing tool on the surface of the substrate with a predetermined torque on the polishing tool during a polishing cycle;

a positioning mechanism operatively connected to said polishing spindle assembly and operable to move said polishing spindle assembly toward and away from the substrate;

a torque sensor associated with said polishing spindle assembly and operable to sense a torque on the polishing tool during the polishing cycle, at least a portion of said torque sensor being mounted to rotate during the polishing cycle; and a control operatively coupled to said positioning mechanism and said torque sensor, said control being responsive to the torque sensed by said torque sensor to adjust positioning of said polishing spindle assembly in at least one of a direction toward and away from the substrate to maintain the torque on the polishing tool substantially constant during the polishing cycle.

2. The apparatus of claim 1 wherein said polishing spindle assembly comprises:

a spindle housing;

a spindle mounted for rotation within said spindle housing and operable to receive the polishing tool; and a spindle motor operatively connected to said spindle for rotating said spindle during a polishing cycle.

3. The apparatus of claim 2 wherein said spindle motor has a motor housing operatively connected to said spindle housing.

4. The apparatus of claim 2 wherein at least a portion of said torque sensor is mounted to rotate with said spindle during the polishing cycle.

5. An apparatus for polishing a surface of a substrate, comprising:

a polishing spindle assembly adapted to support a rotating polishing tool and operable to move in at least one of a direction toward and away from the substrate to contact the polishing tool on the surface of the substrate with a predetermined torque on the polishing tool during a polishing cycle, said polishing spindle assembly comprising a spindle housing, a spindle mounted for rotation within said spindle housing and operable to receive the polishing tool, and a spindle motor operatively connected to said spindle for rotating said spindle during a polishing cycle, said spindle motor having a motor housing operatively connected to said spindle housing;

a positioning mechanism operatively connected to said polishing spindle assembly and operable to move said polishing spindle assembly toward and away from the substrate;

a torque sensor operatively connected to said spindle housing and said motor housing and operable to sense a torque on the polishing tool during the polishing cycle, said torque sensor being operable to sense a relative torque between said spindle housing and said motor housing that corresponds to a torque on the polishing tool during the polishing cycle; and a control operatively coupled to said positioning mechanism and said torque sensor, said control being responsive to the torque sensed by said torque sensor to adjust positioning of said polishing spindle assembly in at least one of a direction toward and away from the substrate to maintain the torque on the polishing tool substantially constant during the polishing cycle.

6. The apparatus of claim 5, wherein said torque sensor is mounted to remain substantially stationary during the polishing cycle.

* * * * *

UNITED STATES PATENT AND TRADEMARK OFFICE

CERTIFICATE OF CORRECTION

PATENT NO. : 6,602,110 B2
DATED : August 5, 2003
INVENTOR(S) : Yi et al.

It is certified that error appears in the above-identified patent and that said Letters Patent is hereby corrected as shown below:

Column 5,
Line 35, delete “along the “2” axis” and insert in place thereof -- along the “Z” axis --.

Signed and Sealed this

Thirteenth Day of January, 2004

JON W. DUDAS
*Acting Director of the United States Patent and Trademark Office*